US009444140B2

(12) United States Patent
Maltsev et al.

(10) Patent No.: US 9,444,140 B2
(45) Date of Patent: Sep. 13, 2016

(54) MULTI-ELEMENT ANTENNA BEAM FORMING CONFIGURATIONS FOR MILLIMETER WAVE SYSTEMS

(71) Applicants: Alexander Maltsev, Nizhny Novgorod (RU); Vadim S. Sergeyev, Nizhny Novgorod (RU); Andrey Pudeyev, Nizhny Novgorod (RU); Ali S. Sadri, San Diego, CA (US); Carlos Cordeiro, Portland, OR (US)

(72) Inventors: Alexander Maltsev, Nizhny Novgorod (RU); Vadim S. Sergeyev, Nizhny Novgorod (RU); Andrey Pudeyev, Nizhny Novgorod (RU); Ali S. Sadri, San Diego, CA (US); Carlos Cordeiro, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 521 days.

(21) Appl. No.: 13/759,642

(22) Filed: Feb. 5, 2013

(65) Prior Publication Data

US 2013/0314280 A1 Nov. 28, 2013

Related U.S. Application Data

(60) Provisional application No. 61/650,730, filed on May 23, 2012.

(51) Int. Cl.
*H01Q 3/36* (2006.01)
*H01Q 3/34* (2006.01)
(Continued)

(52) U.S. Cl.
CPC ..... *H01Q 3/34* (2013.01); *H01Q 3/36* (2013.01); *H01Q 3/40* (2013.01); *H01Q 25/00* (2013.01)

(58) Field of Classification Search
CPC ..... H01Q 3/00; H01Q 3/42; H01Q 3/30; H01Q 3/245
USPC ..... 342/372, 368
See application file for complete search history.

(56) References Cited

U.S. PATENT DOCUMENTS 5,537,242 A * 7/1996 Lim ..... H03C 7/02 250/201.9
6,340,949 B1 * 1/2002 Lane ..... H01Q 1/288 342/354

(Continued)

FOREIGN PATENT DOCUMENTS

EP 0896383 A2 2/1999
WO 2013085523 A1 6/2013

(Continued)

OTHER PUBLICATIONS

International Search Report and Written Opinion Received from PCT Patent Application No. PCT/US2011/063984 mailed on Jun. 28, 2012, 12 pages.

(Continued)

*Primary Examiner* — Harry Liu
(74) *Attorney, Agent, or Firm* — Garrett IP, LLC

(57) ABSTRACT

Multiple transmit antenna beam formers include/share a same set of power amplifiers and antenna elements to form multiple concurrent transmit antenna beams. Multiple receive antenna beam formers include/share a same set of antenna elements and low noise amplifiers to form multiple concurrent receive antenna beams. A transceiver includes the multiple transmit antenna beam formers and the multiple receive antenna beam formers, where the multiple transmit and receive beam formers include/share the same set of antenna elements. The transmit antenna beam formers and the receive antenna beam formers are configured to transmit, receive, and operate in the millimeter wave frequency band.

17 Claims, 6 Drawing Sheets

(51) Int. Cl.
*H01Q 3/40* (2006.01)
*H01Q 25/00* (2006.01)

(56) References Cited

U.S. PATENT DOCUMENTS

| | | | | |
|---|---|---|---|---|
| 6,480,524 | B1 * | 11/2002 | Smith | H04B 7/0408 342/373 |
| 8,466,829 | B1 * | 6/2013 | Volman | G01S 3/48 342/133 |
| 2006/0105733 | A1 | 5/2006 | Singh et al. | |
| 2007/0070814 | A1 * | 3/2007 | Frodyma | G01S 7/003 367/134 |
| 2008/0144689 | A1 | 6/2008 | Crouch et al. | |
| 2008/0254752 | A1 | 10/2008 | Oh et al. | |
| 2008/0318524 | A1 * | 12/2008 | Rofougaran | H01Q 1/2225 455/41.1 |
| 2009/0160707 | A1 | 6/2009 | Lakkis | |
| 2009/0185650 | A1 | 7/2009 | Ravid et al. | |
| 2009/0238156 | A1 | 9/2009 | Yong et al. | |
| 2009/0239480 | A1 * | 9/2009 | Rofougaran | H04L 12/40013 455/73 |
| 2010/0135238 | A1 | 6/2010 | Sadri et al. | |
| 2010/0150254 | A1 * | 6/2010 | Hansen | H04B 7/0617 375/259 |
| 2010/0208633 | A1 | 8/2010 | Takano | |
| 2010/0244962 | A1 * | 9/2010 | Jen | H03F 1/223 330/276 |
| 2010/0278538 | A1 * | 11/2010 | Guidotti | H04B 10/90 398/115 |
| 2010/0295730 | A1 | 11/2010 | Jeon | |
| 2011/0045785 | A1 | 2/2011 | Sutskover et al. | |
| 2011/0076983 | A1 * | 3/2011 | Rofougaran | G06F 19/323 455/404.1 |
| 2011/0080898 | A1 | 4/2011 | Cordeiro et al. | |
| 2011/0122932 | A1 | 5/2011 | Lovberg et al. | |
| 2011/0243040 | A1 | 10/2011 | Khan et al. | |
| 2012/0040629 | A1 | 2/2012 | Li et al. | |
| 2012/0105290 | A1 | 5/2012 | Brown et al. | |
| 2013/0308717 | A1 | 11/2013 | Maltsev et al. | |
| 2014/0294106 | A1 | 10/2014 | Cordeiro et al. | |

FOREIGN PATENT DOCUMENTS

| | | | |
|---|---|---|---|
| WO | 2013154584 | A1 | 10/2013 |
| WO | 2013176930 | A1 | 11/2013 |

OTHER PUBLICATIONS

International Search Report and Written Opinion Received from PCT Patent Application No. PCT/US2012/033602 mailed on Dec. 21, 2012, 10 pages.

Wang, J, et al. "Beam Codebook Based Beamforming Protocol for Multi-Gbps Millimeter-Wave WPAN Systems", IEEE Journal on Selected Areas in Communications, vol. 27, pp. 6 pages.

IEEE, Part 11: Wireless LAN Medium Access Control (MAC) and Physical Layer (PHY) Specification, Prepared by the 802.11 Working Group of the LAN/MAN Standards Committee of the IEEE Computer Society, 2015, 3730 pages.

Maltsev, et al., Apparatus, System And Method Of Multi-input-multi-output (mimo) Beamformed Communication With Space Block Coding, U.S. Appl. No. 13/795,073, filed Mar. 12, 2013, 43 pages.

PCT/US2011/063984, International Preliminary Report on Patentability and Written Opinion received for PCT/US2011/063984, mailed on Jun. 19, 2014, 5 pages.

PCT/US2012/033602, International Preliminary Report on Patentability and Written Opinion received for PCT/US2012/033602, mailed on Oct. 23, 2014, 6 pages.

PCT/US2013/041003, International Preliminary Report on Patentability and Written Opinion Received for PCT Patent Application No. PCT/US2013/041003, mailed on Dec. 4, 2014, 11 Pages.

PCT/US2013/041003, International Search Report Received for PCT Patent Application No. PCT/US2013/041003, nailed on Sep. 12, 2013, 3 pages.

* cited by examiner

MULTI-ELEMENT ANTENNA BEAM FORMING CONFIGURATIONS FOR MILLIMETER WAVE SYSTEMS

CROSS-REFERENCE TO RELATED APPLICATIONS

This application claims the benefit of U.S. Provisional Application Ser. No. 61/650,730, filed May 23, 2012.

BACKGROUND

A phased array antenna includes an antenna beam former to form a phased array antenna beam. The antenna beam former includes radio frequency (RF) signal processing elements coupled to an array of antenna elements (i.e., an antenna array). A multi-beam system may include multiple separate antenna beam formers to form multiple antenna beams, concurrently. Conventionally, separate antenna beam formers include separate antenna arrays. In other words, the multi-beam system divides a given set of antenna elements available in the system among separate antenna beam formers such that each beam former uses a different antenna array. The division of antenna elements reduces the number of antenna elements available to each beam former, and thereby disadvantageously reduces an antenna gain for each formed beam. Conventionally, an increase in antenna gain requires a costly increase in the number of antenna elements allocated to each beam former, which results in a corresponding increase in the size of the system.

Figure 1:
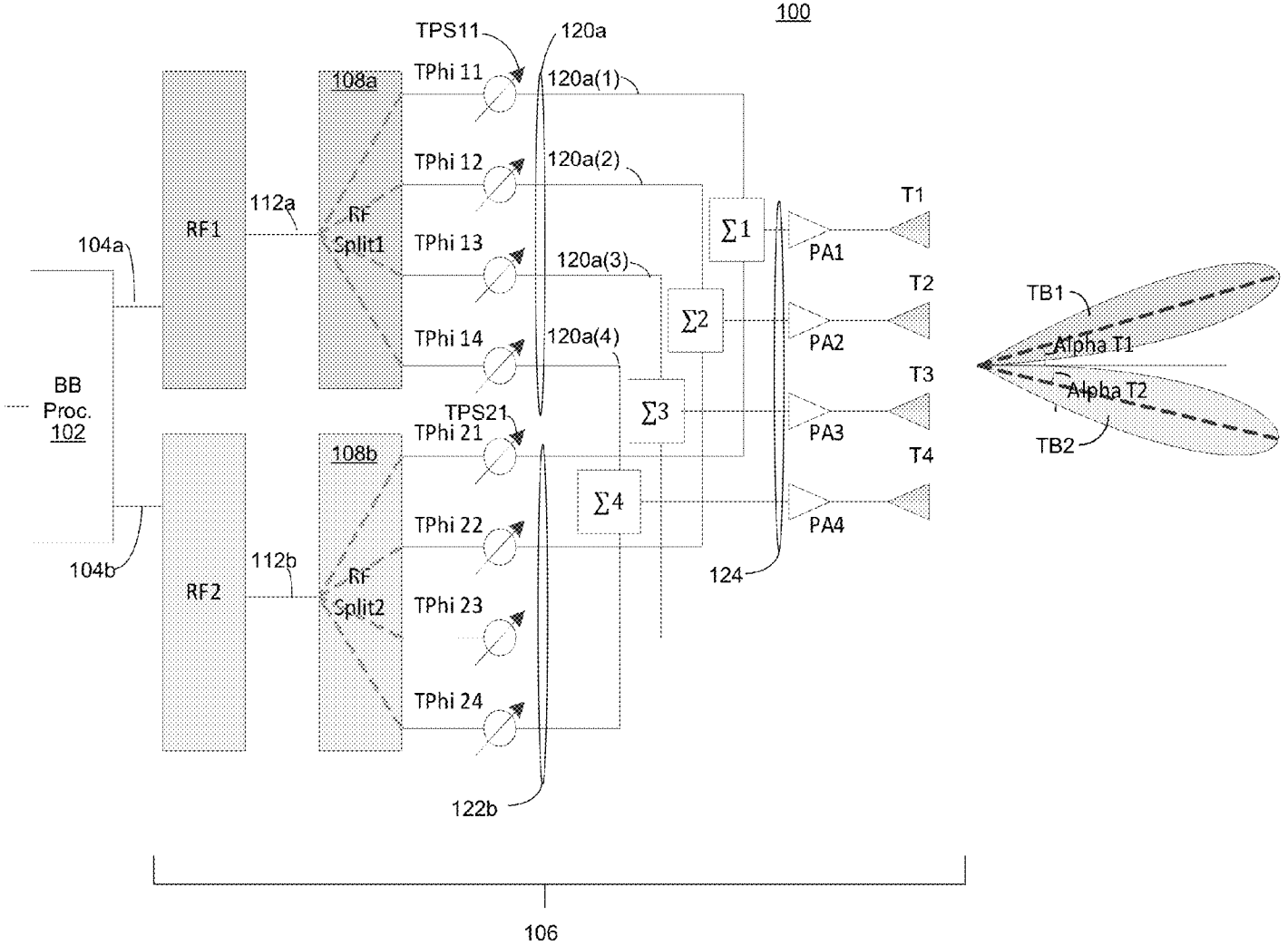
FIG. 1 is a block diagram of an example RF transmit system

In the drawings, the leftmost digit(s) of a reference number identifies the drawing in which the reference number first appears.

Embodiments described herein are directed to: multiple transmit antenna beam formers that include/share a same set of power amplifiers and antenna elements to form multiple concurrent transmit antenna beams; multiple receive antenna beam formers that include/share a same set of antenna elements and low noise amplifiers to form multiple concurrent receive antenna beams; and a transceiver including the multiple transmit antenna beam formers and the multiple receive antenna beam formers, where the multiple transmit and receive beam formers include/share the same set of antenna elements. In various embodiments, the transmit antenna beam formers and the receive antenna beam formers are configured to transmit, receive, and operate in an RF frequency range of 30 to 300 Gigahertz, referred to as a millimeter wave (MMW) frequency band. In other embodiments, the transmit and receive antenna beam formers transmit, receive, and operate at RF frequencies below the MMW frequency band. Because the multiple transmit and receive antenna beam formers operate at MMW frequencies and transmit and receive multiple concurrent antenna beams, respectively, they fully support Multiple-In-Multiple-Out (MIMO) communication protocols in MMW communication systems. Embodiments described herein may be incorporated in one or more devices of a wireless local area network (WLAN) that operates in accordance with any number of wireless standards. Such standards include, but are not limited to, the Institute of Electrical and Electronics Engineers (IEEE) 802.11ad, Wireless Gigabit Alliance "WiGig," standard, in which the devices may transceive RF energy in the 2.4, 5 and 60 Gigahertz bands, to deliver data transfer rates of up to 10 Gigabits per second. Alternatively, embodiments described herein may be incorporated in stand-alone point-to-point communication systems that are not part of a network.

RF Transmitter

FIG. 1 is a block diagram of an example radio frequency (RF) transmit system 100 (i.e., transmitter 100) to radiate RF energy in multiple, concurrent, steerable, transmit antenna beams TB1 and TB2 (also referred to herein as transmit antenna beam patterns TB1 and TB2). Transmitter 100 includes a baseband (BB) processor 102 to produce concurrent baseband signals 104*a*, 104*b*, such as communication signals comprising information to be communicated to one or more remote devices. As used herein, "baseband signals" mean signals having frequencies in a frequency range beginning at or near zero Hertz and extending up to a cut-off frequency well below an RF frequency at which the signals are to be transmitted (or received) wirelessly, e.g., in antenna beam patterns TB1, and TB2.

BB processor 102 provides concurrent BB signals 104*a* and 104*b* to a phased array transmit antenna beam former 106 to processes the BB signals concurrently and thereby generate concurrent transmit antenna beam patterns TB1 and TB2, through which the information in the BB signals is communicated. In another embodiment, BB signals 104*a*, 104*b* may be generated in sequence, in which case transmit antenna beam former 106 generates antenna beam patterns TB1 and TB2 sequentially.

Transmit antenna beam former 106 includes the following elements listed in an order of transmit signal processing flow: RF up-converters RF1 and RF2; RF power splitters 108*a* and 108*b*; programmable phase shifters TPhi11-TPhi24 (indicated as circles in FIG. 1); power combiners Σ1-Σ4; power amplifiers PA1-PA4; and antenna elements or radiators T1-T4. Collectively, RF up-converter RF1, RF power splitter 108*a*, transmit phase shifters TPPhi11-14, and antenna elements A1-A4 operate as a first sub-antenna transmit beam former to form transmit antenna beam pattern TB1. Similarly, RF up-converter RF2, RF power splitter 108*b*, transmit phase shifters TPPhi21-24, and antenna elements A1-A4 operate collectively as a second sub-antenna transmit beam former to form transmit antenna beam pattern TB2. In an embodiment, the elements of transmit antenna beam former 106 are all MMW elements that each operate at MMW frequencies, to radiate transmit antenna beam patterns TB1 and TB2 at MMW frequencies.

With respect to the first sub-antenna transmit beam former, BB processor 102 provides BB signal 104*a* to RF up-converter RF1. RF up-converter RF1 includes frequency mixers and local oscillators configured to frequency up-convert or mix BB signal 104*a* to an input signal 112*a* at an RF frequency. RF power splitter 108*a* power splits or divides signal 112*a* into four signal components, and provides each of the four signal components to a corresponding one of transmit phase shifters TPhi11-PPhi14. Transmit phase shifters TPhi11-PPhi14 receive corresponding programmed phase shift values TPS11-TPS14 (each indicated in FIG. 1 as a diagonal arrow bisecting the circle that represents the corresponding phase shifter) from a controller, which may be BB processor 102 or a different controller (not shown in FIG. 1). In FIG. 1, only phase shift values TPS11 and TPS21 are labeled to avoid confusion. Each of transmit phase shifters TPhi11-14 introduces a corresponding one of programmed phase shifts PS11-PS14 into the corresponding one of the signal components from RF splitter 108*a* received by the given phase shifter, to produce corresponding phase-shifted transmit signal components 120*a*(1)-120*a*(4), indicated collectively at 120*a*.

With respect to the second sub-antenna transmit beam former, RF up-converter RF2, RF power splitter 108*b*, and phase shifters TPhi21-24 are configured to operate similarly to their corresponding components/elements in the first transmit beam former, to produce phase-shifted transmit signal components 120*b* from BB signal 104*b*, based on programmed phase shift values TPS21-TPS24.

Phase-shifters TPhi11-14 in the first sub-antenna transmit beam former and phase shifters TPhi21-24 in the second sub-antenna transmit beam former provide their corresponding phase-shifted transmit signal components to power combiners or summers Σ1-Σ4. Specifically, as depicted in FIG. 1, each of power combiners Σ1-Σ4 combines a corresponding pair of phase-shifted transmit signal components, i.e., one of phase-shifted transmit signal components 120*a* with a corresponding one of phase-shifted transmit signal components 120*b*, to produce combined signal components, indicated collectively at 124. In other words, each of combined signal components 124 includes a corresponding one of the transmit signal components 120*a* and a corresponding one of transmit signal components 120*b*.

Combiners Σ1-Σ4 provide combined signal components 124 to corresponding ones of antenna elements T1-T4 through corresponding ones of power amplifiers PA1-PA4. Antenna elements T1-T4 radiate RF energy responsive to the amplified combined signal components from power amplifiers PA1-PA4. Specifically, antenna elements T1-T4 radiate RF energy in antenna beam patterns TB1 and TB2 formed responsive to transmit phase shifts TPS11-TPS14 and TPS21-TPS24, respectively. Transmit phase shifts TP11-TPS14 and TPS21-TPS24, together with the number and relative positions of antenna elements T1-T4, determine beam gains and corresponding pointing angles Alpha T1 and Alpha T2 of antenna beam patterns TB1 and TB2, respectively.

RF Receiver

Figure 2:
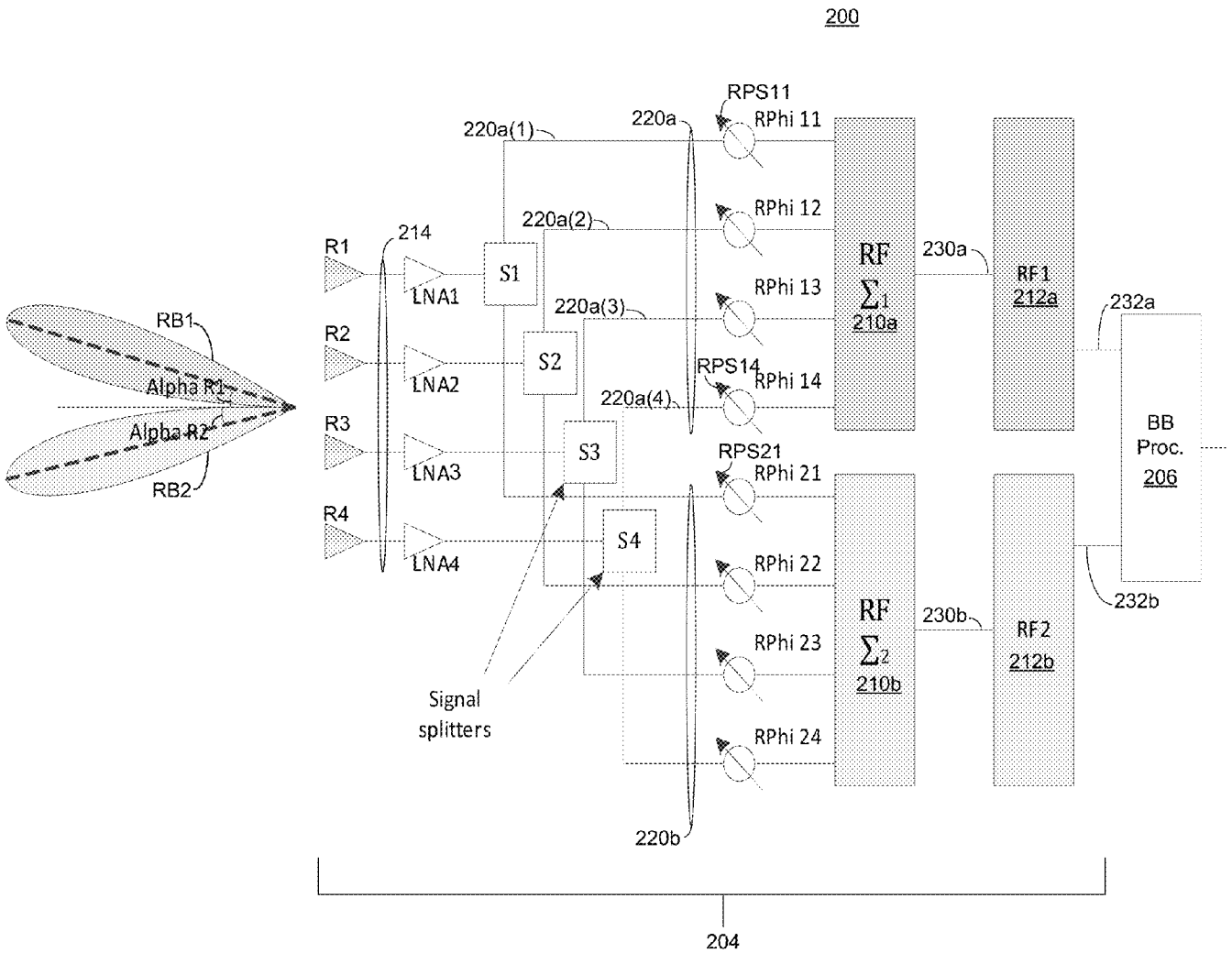
FIG. 2 is a block diagram of an example RF receive system.

FIG. 2 is a block diagram of an example RF receive system 200 (i.e., receiver 200) to receive RF energy in multiple, concurrent, steerable, receive antenna beams RB1 and RB2 (also referred to herein as receive antenna beam patterns RB1 and RB2). Receiver 200 includes a phased array receive antenna beam former 204, followed by a BB processor 206. Phased array receive antenna beam former 204 includes the following signal processing elements listed in an order of receive signal processing flow: antenna elements R1-R4; low noise amplifiers (LNAs) LNA1-LNA4; power splitters S1-S4; receive phase shifters RPhi11-RPhi24; power combiners 210*a* and 210*b*; and RF down-converters 212*a* and 212*b*.

A first sub-antenna receive beam former includes antenna elements R1-R4, phase shifters RPhi11-RPhi14, RF combiner 210*a*, and RF down-converter 212*a* configured to operate collectively to form antenna receive beam pattern RB1. A second sub-antenna receive beam former includes antenna elements R1-R4, phase shifters RPhi21-RPhi24, RF combiner 210*b*, and RF down-converter 212*b* configured to operate collectively to form antenna receive beam pattern RB2. In an embodiment, the elements of receive antenna beam former 204 are all MMW elements that each operate at MMW frequencies, to receive radiation in antenna beam patterns RB1 and RB2 at MMW frequencies, and process the received radiation at MMW frequencies.

Antenna elements R1-R2 generate corresponding receive signals, indicated collectively at 214, responsive to RF energy received through antenna receive beam patterns RB1 and RB2. LNA1-LNA4 amplify corresponding ones of receive signal 214 and provide the amplified receive signals to corresponding inputs of power splitters S1-S4. Power splitters S1-S4 each divide the corresponding (amplified) receive signal into a first signal component and a second signal component, to produce first signal components 220*a* and second signal components 220*b*.

With reference to the first sub-antenna receive beam former, receive phase shifters RPhi11-RPhi14 receive corresponding programmed phase shift values RPS11-RPS14 from BB processor 206 or another controller (not shown in FIG. 2). Only phase shift values RPS11, RPS14, and RPS21 are labeled in FIG. 2 to avoid confusion. Each of receive phase shifters RPhi11-14 introduces its corresponding one of programmed phase shifts RPS11-RPS14 into a corresponding one of signal components 220*a* from RF splitters S1-S4, to produce corresponding phase-shifted receive signal components. Phase shifters RPhi11-14 provide their corresponding phase-shifted signal components to corresponding inputs of RF combiner 210*a*. RF combiner 210*a* power combines the phase-shifted signal components input thereto into a combined output signal 230*a*, and provides the combined output signal to RF down-converter 212*a*. RF down-converter 212*a* includes mixers and local oscillators configured to frequency down-convert output signal 230*a* from an RF frequency to a BB frequency in a BB signal 232*a*, and to provide the BB signal to BB processor 206. The first sub-antenna receive beam former forms receive antenna beam pattern RB1 responsive to receive phase shifts RPS11-RPS14.

With reference to the second sub-antenna receive beam former, receive phase shifters RPhi21-24, RF combiner 210*b*, and RF down-converter 212*b* are configured to operate similarly to their corresponding components/elements in the first sub-antenna receive beam former, to phase-shift, combine and down-convert second signal components 220*b* to a BB signal 232*b*. The second sub-antenna receive beam former forms receive antenna beam pattern RB2 responsive to receive phase shifts RPS21-RPS24.

Receive phase shifts RP11-RPS14 and RPS21-RPS24, together with the number and relative positions of antenna elements R1-R2, determine beam gains and corresponding pointing angles Alpha R1 and Alpha R2 of antenna beam patterns RB1 and RB2, respectively.

RF energy received concurrently in receive beams RB1 and RB2, and translated to signals 214, 220*a*, 220*b*, and so on, is processed concurrently in the components/elements of receive beam former 204, to produce baseband signals 232*a*, 232*b* as concurrent signals.

RF Transceiver

Figure 3:
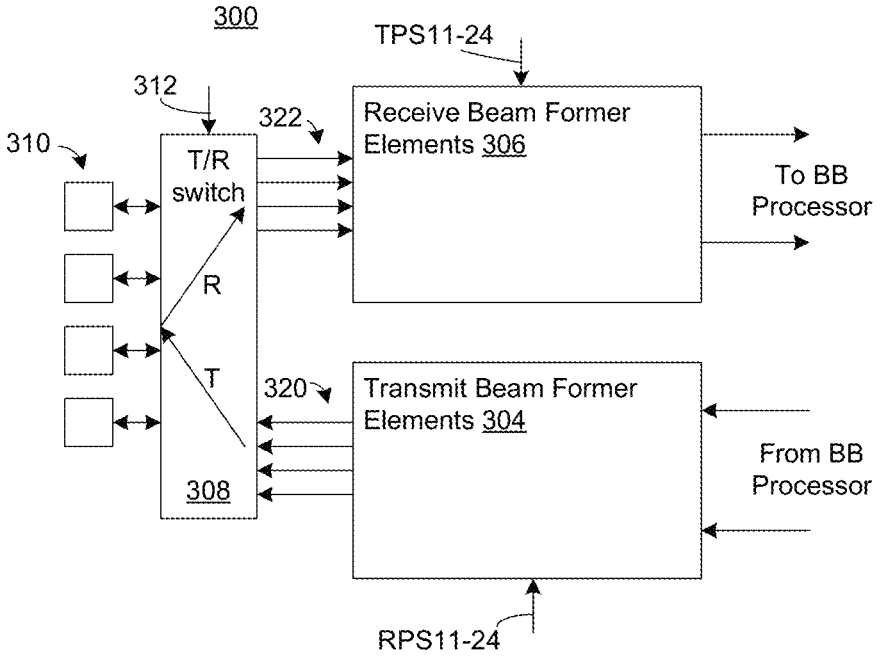
FIG. 3 is a block diagram of an example RF transceiver system.

FIG. 3 is a block diagram of an example RF transceiver system 300 combining transmit beam former elements 304 to form transmit beam patterns and receive beam former elements 306 to form receive beam patterns. Transceiver 300 includes an RF transmit/receive (T/R) switch 308 connected between antenna elements 310 and each of transmit beam former elements 304 and receive beam former elements 306. Transmit beam former elements 304 include the elements of transmit antenna beam former 106 in FIG. 1, except for antenna elements T1-T4. Similarly, receive beam former elements 306 include the elements of receive antenna beam former 204 in FIG. 2, except for antenna elements R1-R2. Transmit beam former elements 304 and receive beam former elements 306 receive transmit phase shifts TPS11-24 and receive phase shifts RPS11-24, respectively. In an embodiment, the elements in 304 and 306 are all MMW elements that each operate at MMW frequencies, to form antenna beams TB1, TB2, RB1, and RB2 at MMW frequencies.

Responsive to a switch signal 312 from e.g., a BB processor, T/R switch 308 selectively connects antenna elements 310 to either transmit beam former elements 304 in a transmit configuration T, or receive beam former elements 306 in a receive configuration R. In the transmit configuration T, T/R switch 308 switches combined signal components 320 (corresponding to combined signals 124, or their amplified versions, in FIG. 1) to antenna elements 310 and, as a result, antenna elements 310 radiate RF energy in transmit antenna beam patters TB1 and TB2 responsive to transmit phase shifts TPS11-24.

In a receive direction, antenna elements 310 also generate receive signals responsive to received RF radiation. In the receive configuration, T/R switch 308 switches the receive signals to receive beam former elements 306 (as switched receive signals 322). Antenna receive beam patterns RB1 and RB2, in which the RF radiation is received, are formed responsive to receive phase shifts RPS11-24 as used in receive beam former elements 306.

Integrated Circuit Chip

Figure 4:
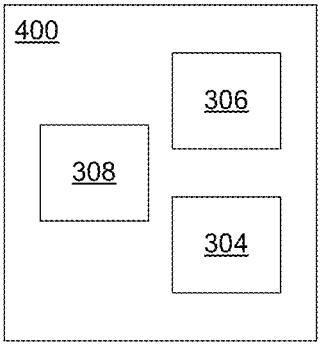
FIG. 4 is a diagram of an example Integrated Circuit (IC) chip.

FIG. 4 is a diagram of an example Integrated Circuit (IC) chip 400 on which transmit beam former elements 304, receive beam former elements 306, and T/R switch 308 are constructed. In an embodiment in which IC chip 400 is a MMW IC chip, the MMW IC chip may be constructed based on Silicon-Germanium (SiGe) BiCMOS (bipolar junction transistor CMOS) or CMOS technology, and may include multi-layers of on-chip microstrip metallization, comprising, e.g., an aluminum composition, to construct various components as described above in the elements 304, 306, and 308. In such an embodiment, the elements all operate at MMW frequencies to form MMW receive and transmit antenna beams.

Figure 5:
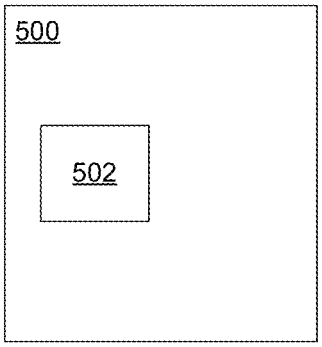
FIG. 5 is a diagram of another example IC chip.

FIG. 5 is a diagram of an example MMW IC chip 500 on which any one of transmit beam former elements 304, receive beam former elements 306, or T/R switch 308 may be constructed.

Method Flow Chart

Figure 6:
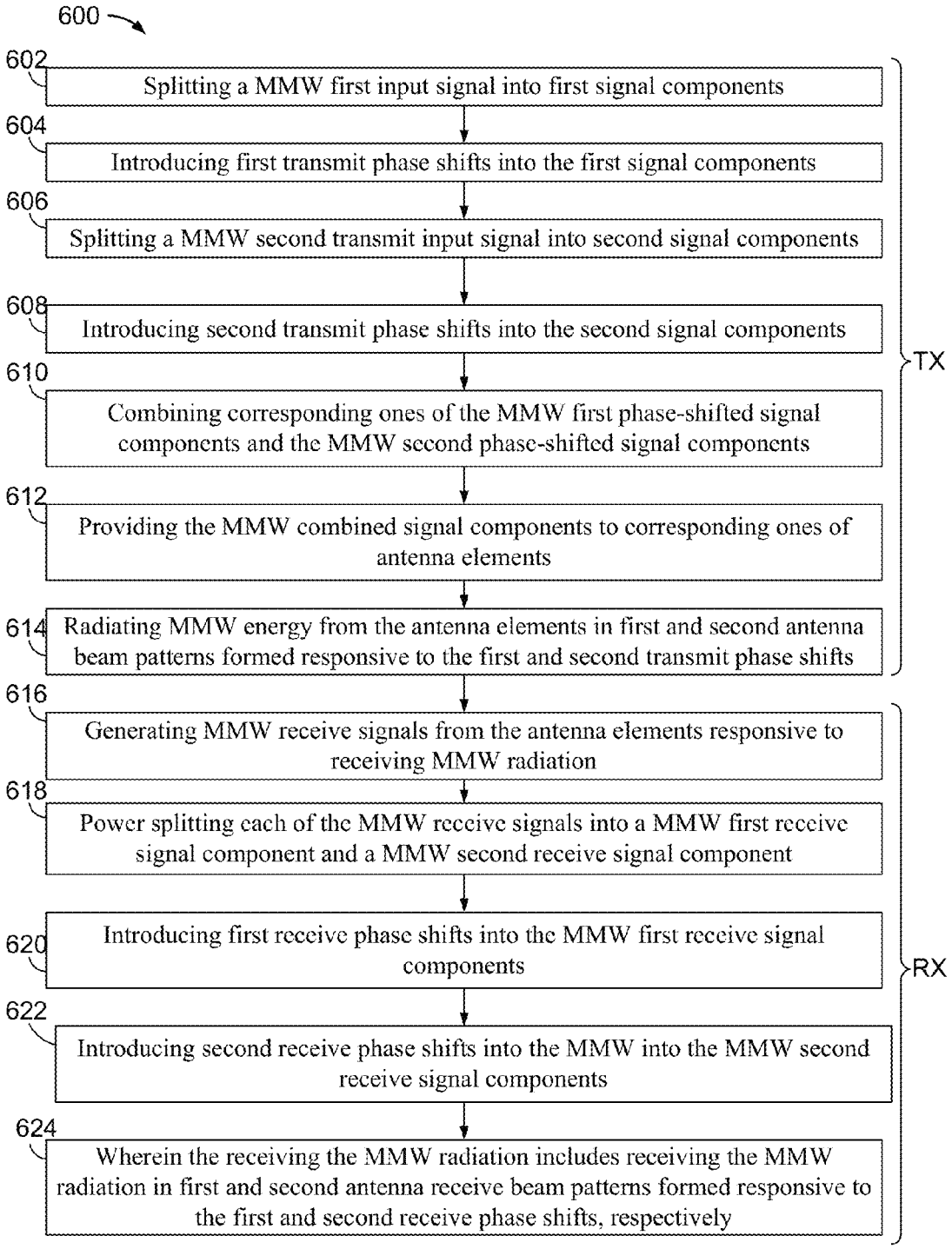
FIG. 6 is a flowchart of an example method of multiple transmit beam forming and multiple receive beam forming.

FIG. 6 is a flowchart of an example method 600 combining a multiple transmit antenna beam forming method (602-614) and a multiple receive antenna beam forming method (616-624) based on MMW signals. The transmit and receive beam forming methods may be performed as separate and distinct methods or combined as depicted in FIG. 6.

MMW transmit antenna beam forming includes the following:

at 602, splitting a MMW first input signal into first signal components;

at 604, introducing first phase shifts into the first signal components;

at 606, splitting a MMW second transmit input signal into second signal components;

at 608 introducing second phase shifts into the second signal components;

at 610, combining corresponding ones of the MMW first phase-shifted signal components and the MMW second phase-shifted signal components;

at 612, providing the MMW combined signal components to corresponding ones of antenna elements; and at 614, radiating MMW energy from the antenna elements in first and second antenna beam patterns formed responsive to the first and second phase shifts.

MMW receive antenna beam forming, includes:

at 616, generating MMW received signals from the antenna elements responsive to receiving MMW radiation;

at 618, power splitting each of the MMW received signals into a MMW first receive signal component and a MMW second receive signal component;

at 620, introducing first receive phase shifts into the MMW first signal components; and at 622, introducing second receive phase shifts into the MMW second receive signal components, wherein, at 624, the receiving the MMW radiation includes receiving the MMW radiation in first and second antenna receive beam patterns formed responsive to the first and second receive phase shifts, respectively.

Methods and systems disclosed herein may be implemented in circuitry and/or a machine, such as a computer system, and combinations thereof, including discrete and integrated circuitry, application specific integrated circuitry (ASIC), a processor and memory, and/or a computer-readable medium encoded with instructions executable by a processor, and may be implemented as part of a domain-specific integrated circuit package, a system-on-a-chip (SOC), and/or a combination of integrated circuit packages.

Computer and System

Figure 7:
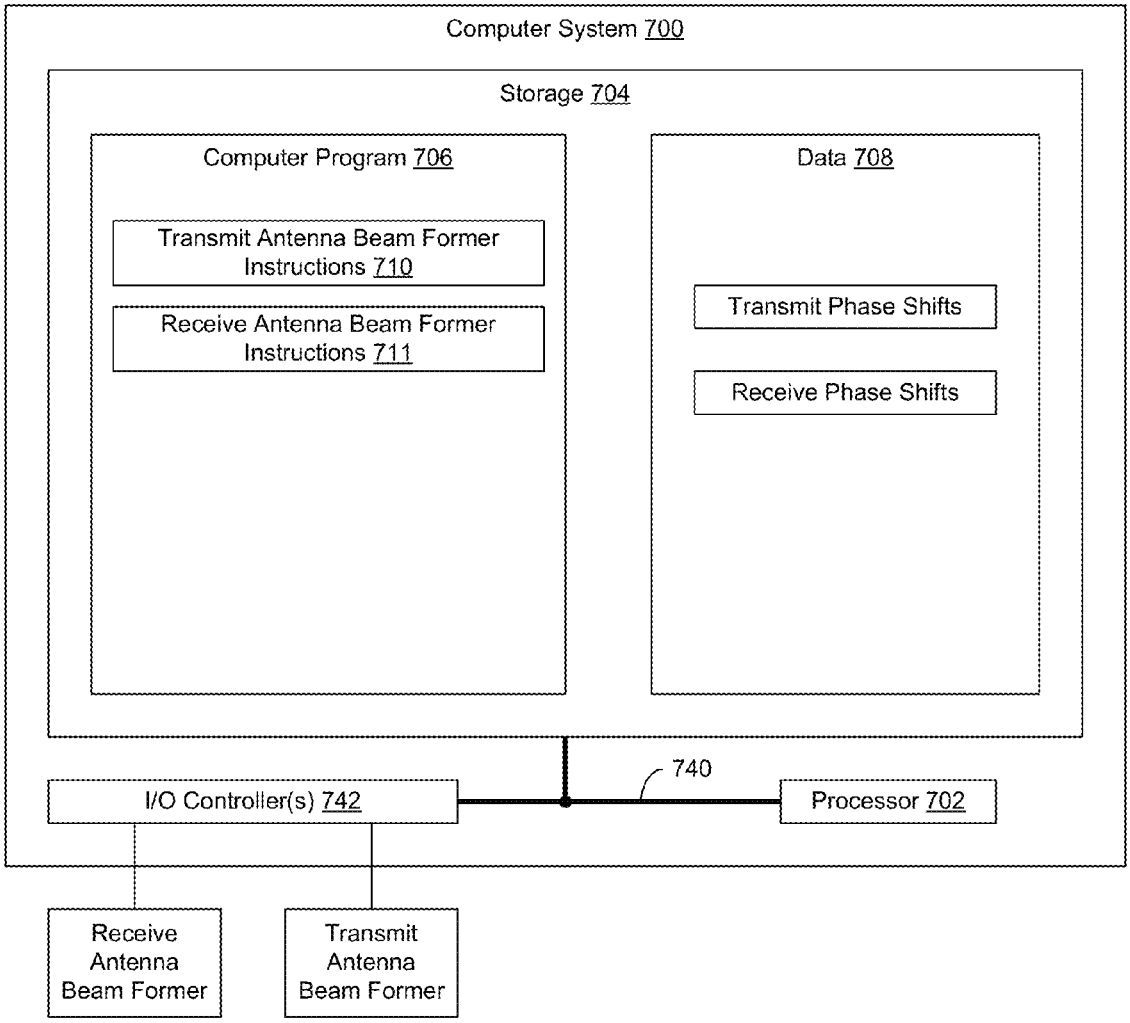
FIG. 7 is a block diagram of an example computer system.

FIG. 7 is a block diagram of a computer system 700, configured to perform any of: configure an RF transmit system to radiate RF energy in one or more concurrent transmit antenna beam patterns responsive to programmable transmit phase shifts; configure an RF receive system to receive RF energy in one or more concurrent receive antenna beam patterns responsive to programmable receive phase shifts; and configure an RF transceiver system to form one or more concurrent receive antenna beam patterns and one or more concurrent transmit beam patters responsive to programmable receive and transmit phase shifts.

Computer system 700 includes one or more computer instruction processor units and/or processor cores, illustrated here as a processor 702, to execute instructions of a computer program 706. Processor 702 may include a general purpose instruction processor, a controller, a microcontroller, or other instruction-based processor.

Computer program 706, also referred to as computer program logic or software, may be encoded within a computer readable medium, illustrated here as storage 704, which may include a non-transitory medium. In the example of FIG. 7, computer program 706 includes transmit beam former instructions 710 to cause processor 702 to provide programmable transmit phase shift values to transmit phase shifters in a communication system including a transmit antenna beam former, such as described in one or more examples above. Computer program 706 includes receive beam former instructions 711 to cause processor 702 to provide programmable receive phase shift values to receive phase shifters in a communication system including a receive antenna beam former, such as described in one or more examples above.

Computer system 700 may include communications infrastructure 740 to communicate amongst devices and/or resources of computer system 700.

Computer system 700 may include one or more input/output (I/O) devices and/or controllers 742 to communicate with one or more other systems, such as with an RF transmit system and/or an RF receive system.

Methods and systems disclosed herein may be implemented with respect to one or more of a variety of systems, such as described below with reference to FIG. 8. Methods and systems disclosed herein are not, however, limited to the examples of FIG. 8.

Figure 8:
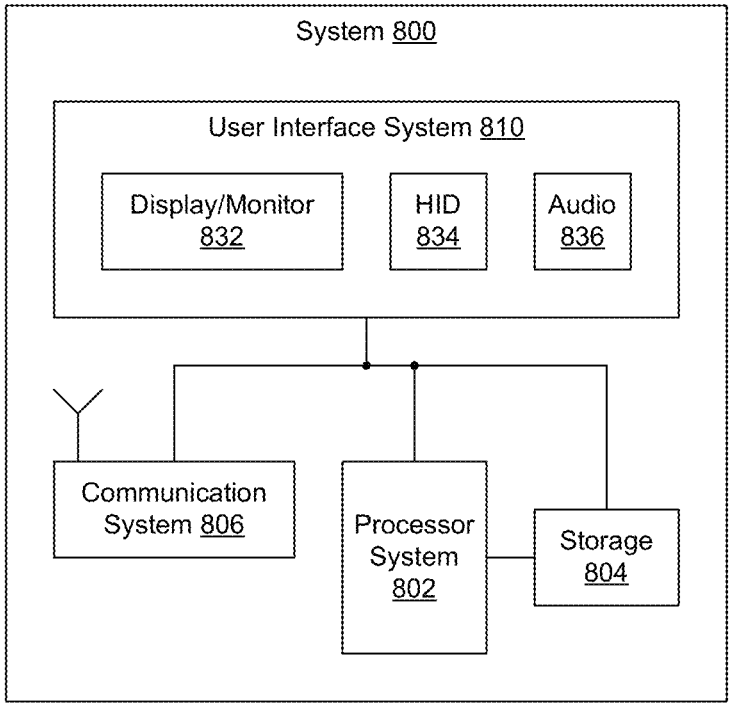
FIG. 8 is a block diagram of an example system.

FIG. 8 is a block diagram of a system 800, including a processor system 802, memory or storage 804, a communication system 806, and a user interface system 810. Communication system 806 may include one or more RF systems, such as an RF transmit system, an RF receive system, and an RF transceiver system as described in one or more examples above. A BB processor may be implemented in one or more of communication system 806 and processor system 802.

Storage 804 may be accessible to processor system 802, communication system 806, and/or user interface system 810.

User interface system 810 may include a monitor or display 832 and/or a human interface device (HID) 834. HID 834 may include, without limitation, a key board, a cursor device, a touch-sensitive device, a motion and/or image sensor, a physical device and/or a virtual device, such as a monitor-displayed virtual keyboard. User interface system 810 may include an audio system 836, which may include a microphone and/or a speaker.

System 800 may correspond to, for example, a computer system and/or a communication device and may include a housing such as, without limitation, a rack-mountable housing, a desk-top housing, a lap-top housing, a notebook housing, a net-book housing, a tablet housing, a telephone housing, a set-top box housing, and/or other conventional housing and/or future-developed housing. Processor system 802, storage 804, communication system 806, and user interface system 810, or portions thereof, may be positioned within the housing.

System 800 or portions thereof may be implemented within one or more integrated circuit dies, and may be implemented as a system-on-a-chip (SoC).

An apparatus embodiment comprises:

antenna elements to radiate millimeter wave (MMW) energy;

MMW first transmit phase shifters to introduce first phase shifts into first signal components;

MMW second transmit phase shifters to introduce second phase shifts into second signal components; and MMW combiners each to combine corresponding ones of the first and second phase-shifted signal components, and to provide each of the combined signal components to a corresponding one of the antenna elements, wherein the antenna elements are configured to radiate the MMW energy in first and second transmit antenna beam patterns formed responsive to the first and second phase shifts, respectively.

The apparatus further comprises MMW power amplifiers each coupled to a respective one of the combiners and a respective one of the antenna elements, wherein the antenna elements, first and second phase shifters, combiners, and power amplifiers are configured to operate concurrently on their respective signals so as to cause the antenna elements to radiate the first and second transmit antenna beam patterns concurrently.

The apparatus further comprises:

a first up-converter to up-convert a first baseband signal to an MMW first input signal;

a MMW first power splitter to power split the first input signal into the first signal components;

a second up-converter to up-convert a second baseband signal to an MMW second input signal; and a MMW second power splitter to power split the second input signal into the second signal components.

The apparatus further comprises a MMW integrated circuit (IC) chip, wherein the up-converters, the dividers, the first and second transmit phase shifters, and power amplifiers may be all constructed on the MMW integrated circuit (IC) chip.

The antenna elements may be configured to receive MMW energy and generate receive signals responsive to the received MMW energy, and the apparatus may further comprise:

MMW power splitters each to power split a corresponding one of the receive signals into a first signal component and a second signal component;

MMW first receive phase shifters to introduce first receive phase shifts into the first signal components; and MMW second receive phase shifters to introduce second receive phase shifts into the second signal components, wherein the antenna elements are configured to receive the MMW energy in first and second antenna receive beam patterns formed responsive to the first and second receive phase shifts, respectively.

The apparatus may further comprise a transmit-receive (T/R) switch to selectively switch the phase-shifted transmit signals from the transmit phase shifters to the antenna elements, and switch the receive signals from the antenna elements to the receive phase shifters.

The apparatus may further comprise a MMW integrated circuit (IC) chip, wherein the first and second transmit phase shifters, the combiners, the power splitters, and the first and second receive phase shifters are all constructed on the MMW IC chip.

The apparatus may further comprise:

a processor and memory to provide the first and second phase shifts;

a housing to house the processor and memory, the transmit phase shifters, and the combiners.

Another apparatus embodiment comprises:

antenna elements to generate respective millimeter wave (MMW) signals responsive to MMW energy;

MMW power splitters each to power split a corresponding one of the MMW signals into a first signal component and a second signal component;

MMW first phase shifters to introduce first phase shifts into the first signal components; and MMW second phase shifters to introduce second phase shifts into the second signal components, wherein the antenna elements are configured to receive the MMW energy in first and second antenna beam patterns formed responsive to the first and second phase shifts, respectively.

The antenna elements, power splitters, and first and second phase shifters may be configured to operate concurrently on their respective signals so as to cause the antenna elements to form their first and second receive antenna beam patterns concurrently.

The apparatus may further comprise:

MMW first combiners to combine the first phase-shifted signal components into a first signal;

a first down-converter to down-convert the first signal from a first MMW frequency to a first baseband frequency;

MMW second combiners to combine the second phase-shifted signal components into a second signal; and a second down-converter to down-convert the second signal from a MMW frequency to a second baseband frequency.

The apparatus may further comprise a MMW integrated circuit (IC) chip, wherein the power splitters, the first and second phase shifters, the first and second combiners, and the first and second down-converters are all constructed on the MMW IC chip.

The apparatus may further comprise:

a processor and memory to provide the first and second phase shifts;

a housing to house the processor and memory, the power splitters, and the first and second receive phase shifters.

A transceiver apparatus embodiment comprises:

antenna elements;

MMW transmit phase shifters to introduce transmit phase-shifts into transmit signals and provide the phase-shifted transmit signals to the antenna elements; and MMW receive phase shifters to introduce receive phase-shifts into signals received from the antenna elements, wherein the antenna elements are configured to radiate MMW energy in multiple concurrent transmit beam patterns formed responsive to the transmit phase shifts, and receive MMW energy in a multiple concurrent receive beam patterns formed responsive to the receive phase shifts.

The apparatus may further comprise transmit-receive (T/R) switches to switch the phase-shifted transmit signals from the transmit phase shifters to the antenna elements, and switch the received signals from the antenna elements to the receive phase shifters.

The apparatus may further comprise a MMW integrated circuit (IC) chip, wherein the transmit and receive phase shifters and the T/R switches are all constructed on the MMW IC chip.

In the apparatus, the transmit and receive phase shifters may be programmable, and the apparatus may further comprise a processor and memory configured to program the transmit and receive phase shifts of the programmable transmit and receive phase shifters.

A method embodiment comprises:

millimeter wave (MMW) transmit antenna beam forming, including:

splitting a MMW first input signal into first signal components;

introducing first phase shifts into the first transmit signal components;

splitting a MMW second input signal into second signal components;

introducing second phase shifts into the second signal components;

combining corresponding ones of the MMW first phase-shifted signal components and the MMW second phase-shifted signal components;

providing the MMW combined signal components to corresponding ones of antenna elements; and radiating MMW energy from the antenna elements in first and second antenna beam patterns formed responsive to the first and second phase shifts.

The method may further comprise:

MMW receive antenna beam forming, including:

generating MMW receive signals from the antenna elements responsive to receiving MMW radiation;

power splitting each of the MMW receive signals into a MMW first receive signal component and a MMW second receive signal component;

introducing first receive phase shifts into the MMW first receive signal components; and introducing second receive phase shifts into the MMW into the MMW second receive signal components, wherein the receiving the MMW radiation includes receiving the MMW radiation in first and second antenna receive beam patterns formed responsive to the first and second receive phase shifts, respectively.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What is claimed is:

1. An apparatus, comprising a transmitter configured to:

modulate first and second radio frequency (RF) signals with respective first and second baseband signals;

split each of the first and second modulated RF signals into multiple components;

phase shift the components of the first modulated RF signal relative to one another;

phase shift the components of the second modulated RF signal relative to one another; and output the phase shifted components of the first and second modulated RF signals to elements of an antenna to radiate the first modulated RF signal from the elements of the antenna in a first pattern and to radiate the second modulated RF signal from the elements of the antenna in a second pattern.

2. The apparatus of claim 1, wherein the transmitter is further configured to process the first and second baseband signals concurrently to radiate the first and second modulated RF signals concurrently with respect to one another.

3. The apparatus of claim 1, wherein the transmitter is further configured to process the first and second baseband signals sequentially with respect to one another to radiate the first and second modulated RF signals sequentially with respect to one another.

4. The apparatus of claim 1, wherein:

the transmitter includes programmable phase shifters to phase shift the components of the first and second modulated RF signals; and the apparatus further includes an integrated circuit device that includes the transmitter, the antenna, and a controller to control the programmable phase shifters.

5. The apparatus of claim 4, wherein the transmitter and antenna are configured to radiate the first and second modulated RF signals as millimeter wavelength RF signals.

6. The apparatus of claim 1, wherein the transmitter includes:

first and second frequency converters to modulate the first and second RF signals with the respective first and second baseband signals;

first and second signal power splitters, each to split a respective one of the first and second modulated RF signals into the multiple components;

a first phase shifter to phase shift the components of the first modulated RF signal relative to one another;

a second phase shifter to phase shift the components of the second modulated RF signal relative to one another; and multiple signal combiners, each to receive a phase shifted component of each of the first and second modulated RF signals;

wherein the transmitter is further configured to provide an output of each of the signal combiners to a respective element of the antenna.

7. The apparatus of claim 1, further including a receiver configured to:

split a receive output of each element of the antenna into first and second receive components;

phase shift the first components relative to one another;

combine the phase shifted first components to provide a first RF receive signal;

demodulate a first baseband receive signal from the first RF receive signal;

phase shift the second components relative to one another;

combine the phase shifted second components to provide a second RF receive signal; and demodulate a second baseband receive signal from the second RF receive signal.

8. The apparatus of claim 7, further including an integrated circuit device that includes the transmitter, the receiver, and the antenna to radiate and receive millimeter wavelength RF signals.

9. An apparatus, comprising a receiver that includes:

multiple signal splitters, each to receive an output of a respective one of multiple elements of an antenna;

a first receive path to receive a first output of each of the signal splitters, phase shift the first outputs relative to one another, combine the phase shifted first outputs to provide a first RF receive signal, and demodulate a first baseband receive signal from the first RF receive signal; and a second receive path to receive a second output of each of the signal splitters, phase shift the second outputs relative to one another, combine the phase shifted second outputs to provide a second RF receive signal, and demodulate a second baseband receive signal from the second RF receive signal.

10. The apparatus of claim 9, wherein:

the first and second receive paths each includes programmable phase shifters to phase shift the respective outputs of the signal splitters; and the apparatus further includes an integrated circuit device that includes the receiver, the antenna, and a controller to control the programmable phase shifters.

11. A method, comprising:

modulating first and second radio frequency (RF) signals with respective first and second baseband signals;

splitting each of the first and second modulated RF signals into multiple components;

phase shifting the components of the first modulated RF signal relative to one another;

phase shifting the components of the second modulated RF signal relative to one another; and outputting the phase shifted components of the first and second modulated RF signals a multi element antenna to radiate the first modulated RF signal from the elements of the antenna in a first pattern and to radiate the second modulated RF signal from the elements of the antenna in a second pattern.

12. The method of claim 11, further including processing the first and second baseband signals concurrently to radiate the first and second modulated RF signals concurrently with respect to one another.

13. The method of claim 11, further including processing the first and second baseband signals sequentially with respect to one another to radiate the first and second modulated RF signals sequentially with respect to one another.

14. The method of claim 11, wherein the phase shifting the components of the first modulated RF signal and the phase shifting the components of the second modulated RF signal each includes phase shifting the components of the respective modulated RF signal based on programmable phase shift parameters.

15. The method of claim 11, further including:

splitting a receive output of each of the elements of the antenna into first and second receive components;

phase shifting the first receive components with respect to one another;

combining the phase shifted first components to provide a first RF receive signal;

demodulating a first baseband receive signal from the first RF receive signal;

phase shifting the second receive components with respect to one another;

combining the phase shifted second components to provide a second RF receive signal; and demodulating a second baseband receive signal from the second RF receive signal.

16. A method of concurrently recovering multiple baseband signals from radio frequency (RF) energy received at a phased array antenna, comprising:

splitting RF energy received by each of multiple radiation elements of the antenna into first and second portions of RF energy, in respective power splitters;

phase shifting the first portions of RF energy relative to one another based on a first beam pattern, in a first beam former;

phase shifting the second portions of RF energy relative to one another based on a second beam pattern, in a second beam former, concurrently with the phase shifting the first portions of RF energy;

combining the phase shifted first portions of RF energy to provide a first RF signal, in the first beam former;

combining the phase shifted second portions of RF energy to provide a second RF signal, in the second phased array beam former, concurrently with the combining the phase shifted first portions of RF energy;

demodulating the first and second RF signals in a demodulator to provide respective first and second baseband signals; and providing the first and second baseband signals to a baseband processor.

17. The method of claim 16, wherein the phase shifting the first portions of RF energy and the phase shifting the second portions of RF energy each includes phase shifting the respective portions of RF energy based on programmable phase shift parameters.

* * * * *